United States Patent [19]

Greenwald, Sr.

[11] Patent Number: 4,537,599

[45] Date of Patent: Aug. 27, 1985

[54] PROCESS FOR REMOVING SULFUR AND ASH FROM COAL

[76] Inventor: Edward H. Greenwald, Sr., 92 Nancy La., McMurray, Pa. 15317

[21] Appl. No.: 598,979

[22] Filed: Apr. 16, 1984

Related U.S. Application Data

[63] Continuation-in-part of Ser. No. 489,568, Apr. 28, 1983, abandoned.

[51] Int. Cl.[3] ..... C10L 9/02

[52] U.S. Cl. ..... 44/1 SR; 44/10 R; 209/173

[58] Field of Search ..... 44/15 R, 10 R, 16 C; 201/17; 209/162, 171, 173, 199

[56] References Cited

U.S. PATENT DOCUMENTS

| | | | |
|---|---|---|---|
| 3,824,084 | 7/1974 | Dillon et al. | 44/1 SR |
| 4,105,416 | 8/1978 | Burk, Jr. et al. | 44/1 SR |
| 4,272,251 | 6/1981 | Beckberger et al. | 44/1 SR |
| 4,391,608 | 7/1983 | Dondelewski | 44/1 SR |

*Primary Examiner*—Carl F. Dees

*Attorney, Agent, or Firm*—Thomas H. Murray; Clifford A. Poff

[57] ABSTRACT

A process is disclosed for removing sulfur and ash, particularly clay and pyrite from coal particles having a mesh size of 30 or less. A slurry of coal particles is agitated in an ultrasonic mixer to separate the contaminants from the coal and weaken chemically-bonded contaminants on the coal surface. The clay and pyrite particles are dispersed as a colloid in the aqueous medium of the slurry. Treatment of the slurry with sonic energy also subdivides the particles along ash or clay seams. The slurry is then separated in a centrifuge and in froth-flotation cells so that coal particles greater than 2 microns are recovered and a slurry is again formed. The repulped slurry is then treated with sonic energy and ozone to release further quantities of surface components from the coal particles. The slurry is again treated in a centrifuge and coal particles 2 microns and greater are recovered. The slurry is normalized before each treatment with sonic energy and ozone to a pH of 6–9 to maintain the released contaminants as colloids suspended in the aqueous medium of the slurry.

32 Claims, 2 Drawing Figures

PROCESS FOR REMOVING SULFUR AND ASH FROM COAL

CROSS-REFERENCE TO RELATED APPLICATION

Figure 1:
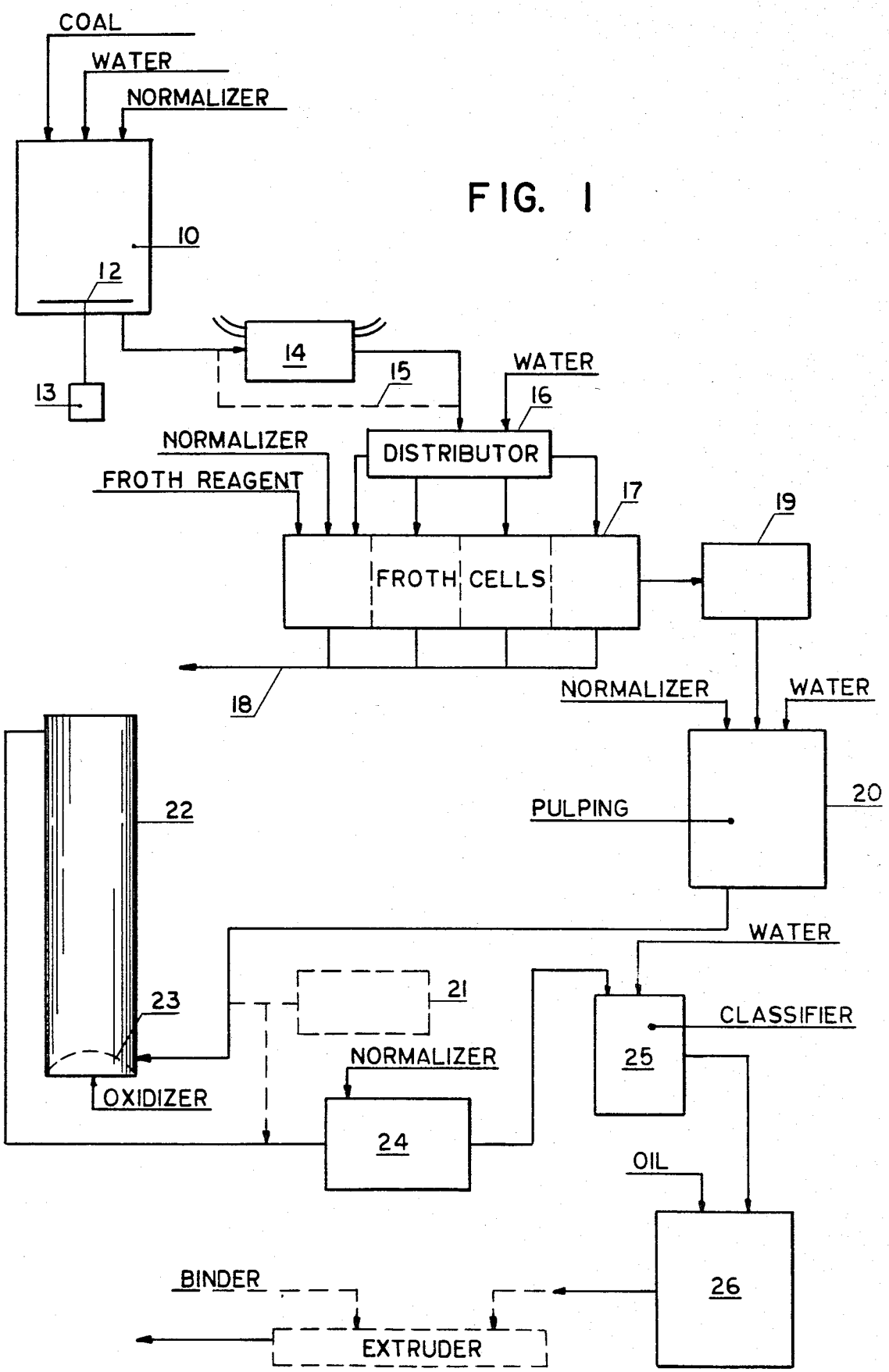

This application is a continuation-in-part of application Ser. No. 489,568, filed Apr. 28, 1983 abandoned.

BACKGROUND OF THE INVENTION

This invention relates to freeing ash and sulfur in the form of clay and pyrite particles implanted on the surface of coal particles, particularly, ultrafine coal particles, for dispersion as a colloid in a colloidal suspension and then effecting a separation of the impurities from the coal particles. More particularly, the present invention provides a process to mechanically and/or chemically remove clay and pyrite from raw coal or a run of the mine coal mixture by treating coal particles with high energy chemical and/or physical forces such as those generated by oxygen in its several forms such as ozone or by oxidants, or by ultrasonics, or by each in the various possible combinations to release clay and pyrite particles that are adhered to the surfaces of the coal particles by mechanical or chemical bonding or by an electrostatic force as well as releasing such impurities from a newly-exposed surface of subdivided coal particles.

Coal-cleaning processes according to the present state-of-the-art are generally ineffective for removing ash and sulfur constituents wholly embedded within or bonded to the exposed surfaces of coal particles. In these coal-cleaning processes, impurities in a free state such as clay, shale, sand, pyrite and other minerals are selectively separated from coal particles using devices that depend upon relative differences in specific gravity of the particles to be separated, such as with dense media circuits or the relationship of particle size to bulk density, such as in up-current classification or the differential affinity of coal for other hydrocarbons, such as in froth-flotation and oil agglomeration.

As the particle size of coal and associated impurities in a free state diminishes, the separation process becomes more and more difficult and is executed with less and less efficiency. Since ultrafine impurities, particularly clay particles, are hydrophilic and thus display a great affinity for water, the recovery of ultrafine coal of less than total purity bears the additional burden imposed by the need to reduce moisture content through expensive means such as thermal drying. As a result, historically, it has been the practice to waste the ultrafine coal particles with their associated impurities to ponds or dumps or accept the practice of recovering an impure product with high moisture content and low market value.

The economics for the combustion of coal as fuel place a premium on coal with a low ash and sulfur content. Non-combustible ash, such as clay, sand, shale and other minerals require collection, material handling and disposal; whereas sulfur components, regardless of the form of occurrence, must be effectively removed from the combustion gases with other particulates including fly ash.

It has been proposed to introduce ozone into a vessel containing raw coal in an aqueous suspension to modify the surface of the coal particle and release the ash constituents, thereby permitting a more thorough separation of coal from ash by conventional means. The ozone is introduced into a vessel containing a slurry of coal crushed to a size range of ½" or less in a highly-agitated state. Ozone is pumped into the bottom of the coal-water mixture at the rate of 1/10 to 5 pounds per ton of coal and preferably about ½ to 1 pound per ton of coal. The reaction time is from 5 to 30 minutes at room temperature and atmospheric pressure. Thereafter, a series of separation steps are employed to separate the coal from the ash. First, the coarser particles are screened from the ultrafines that are then fed through cyclone or Deister table separators. Underflow from the separating screen, consisting of fine coal and ash, is to be treated in froth-flotation cells. Since the effect of ozone treatment on the surface of the fine coal particles is one that destroys the ability of the coal particles to properly respond to froth-flotation treatment, the recovered product, if any can be recovered, will still contain the majority of the impurities and, in particular, flakes of pyrite less than 25 microns in size. In such a process, a substantial percentage of the recoverable carbon is lost with the tailings that exit from the froth cell. The process does not attempt a separation of impurities from coal particles less than 105 microns and uses conventional devices for dewatering or moisture reduction which is inadequate. Further, since the ozone or oxidant can only react to impurities exposed on the surfaces of the coal particles, the ratio of exposed surface area to weight of individual particles renders the treatment of little practical value in the reduction of ash and sulfur in particles of a size greater than 30 mesh or 595 microns. Moreover, the cost of the oxidizing process is increased by the consumption of ozone or oxidant by the impurities, particularly pyrite, in a free state in the raw coal slurry, viz-a-viz those bonded to the surface of the coal particles and targets for the treatment. It has been discovered, contrary to the known belief, that oxidizing coal in a slurry with ozone is a highly pH dependent process. Further, the most favorable environment for efficient gas-to-liquid-to-solid contact in the process to treat coal with ozone in a slurry is under quiescent conditions. Also, contrary to the known belief, after the water slurry of coal particles is treated with ozone, the oxidized surfaces of the coal particles are so altered that separation of tailings from the coal particles cannot be carried out by conventional means such as froth-flotation. The economic impact of a substantial loss of carbon in the tailings could render the entire process uneconomical, if not unworkable, in many possible applications. By actual tests, it has been proven that all but a minor portion of the ash and sulfur reduction attributed to the ozone treatment, according to the known process, can be achieved through a careful application of conventional means.

In U.S. Pat. No. 4,328,002, there is disclosed a process for treating coal to remove sulfur and ash which involves the steps of preconditioning coal particles in the presence of an aqueous solution of an oxidizing agent, e.g., detergent; washing the pretreated coal with water; contacting the coal with an aqueous solution of an oxidizing agent until an exothermic reaction between the coal and oxidizing agent peaks and the pH drops to the range of 2 to 3; removing the coal from the oxidizing agent; contacting the coal with a passivating agent until the temperature of the coal drops and the pH rises into the range of 3 to 5; neutralizing the coal up to a pH of about 9; washing the coal with water and drying the coal. It has been discovered that the use of the disclosed oxidants $H_2O_2$, $HNO_3$, $HCLO_4$, HF, $O_2$, air and mild $NH_3$ or $CO_2$ is substantially ineffective to provide a useful result. Moreover, the known process treats the raw coal feedstock with the oxidants without first separating free impurities and sulfur which consume reactants and impede the recovery of ultrafine carbon by conventional means. Conventional means, such as froth-flotation, cannot be used to separate ultrafine impurities that are freed by the action of the oxidant from the clean carbon particles. The known process for using an oxidant for coal, as just described, is further deficient because it does not provide for the separation of impurities from coal particles less than 105 microns in size which also does not permit adequate dewatering or moisture reduction of the coal.

In U.S. Pat. No. 4,326,855, there is disclosed a process for beneficiating and stabilizing coal. A water slurry of coarsely-ground coal is agitated and then separated by froth-flotation. The tailings are ash and pyrite. Coal and water recovered from the froth-flotation process are fed to an attrition mill where the coal is ground and fed to a sonic reactor together with the optional addition of oil. The slurry is sonified through violent sonic agitation with sufficient energy to cause cavitation and for a time sufficient to reduce the particle size of the coal even further because pyrite and ash break away from the coal. The agglomerate and water mixture is then screened to separate coal particles from most of the contaminated water. The recovered coal-water mixture is about 10% to 40% water. The spherical agglomerates are mixed with oil to about 0.6 times the weight of the coal to produce a fuel. It is undesirable to form an agglomerate through the use of oil since this impedes separation of tailings from the treated coal particles. The present invention provides a process to overcome the shortcomings and disadvantages of known processes for beneficiating coal.

SUMMARY OF THE INVENTION

It is an object of the present invention to separate a substantial part of the ash and sulfur which is not inherent but is attached to the surface of minus 105-micron coal particles whether in a raw state or after cleaning.

It is a further object of the present invention to provide a process for separating particles of impurities including sulfur, e.g., pyrite, which is primarily 2 microns or smaller in size from coal particles.

It is another object of the present invention to provide a process for freeing particles of impurities from the surface of coal and maintaining the impurities in suspension as a colloid in a liquid medium from which the impurities are separated from the coal particles, thus rendering the coal particles as free of impurities as possible without expensive refining process using solvent methods or chemical destruction methods.

It is a further object of the present invention to provide a process for treating coal particles in a slurry by first agitating the slurry to release ash and sulfur from the coal particles and after the tailings are separated therefrom, repulping coal particles and treating them with a high energy compound such as ozone.

Specifically, the present invention provides a process for treating a slurry containing coal particles which are entrained with particles of impurities that are free or not attached to the coal particles; have impurities physically attached to the coal particles; and have impurities chemically or electrostatically bonded to the surface of the coal particles. The process has maximum effect when the size of the coal particles is generally 30 mesh or less. A slurry of the coal particles is first agitated by mechanical and/or ultrasonic energy to such an extent as practical and sufficient to free attached particles of impurities containing ash and sulfur, i.e., clay and pyrite, from the coal particles and to permit separation of the coal particles from impurities by an economic process in a separator which may include froth-flotation cells. The clay and pyrite particles have a size of generally minus 2 microns and are dispersed in the aqueous medium of the slurry at or near normalities and maintained as a colloid therein which prevents reattachment of the contaminant particles to the coal particles before the first separation stage. Froth flotation provides an effective separation of contaminants of plus 2-micron size from the coal particles.

After the tailings are separated from the treated coal particles, the coal particles are repulped and treated with a high energy reactant such as ozone or other oxidant and/or with ultrasonic energy to free tightly-bonded clay and pyrite particles from the surface of the coal particles. The clay and pyrite thus freed are again dispersed as a colloid in the aqueous medium of the slurry and maintained as a colloid therein to prevent reattachment of the contaminant to the surface of the coal particles prior to final separation. The dispersed clay and pyrite particles are separated from the coal particles at a predetermined particle size separation generally in the range of from 2 to 25 microns by a classification process using a mechanical or centrifugal force. Fresh rinse water and chemical reactants are useful for the separation process. The coal product from the final classification process may be formed into a cake or other convenient shape or the coal product may be used to form a coal-water mixture. When formed into a cake or other shape, the moisture content of the final product may vary from less than 20% to more than 50% depending upon the particle size or particle distribution in the product. The recovered coal may be treated by mixing or milling in the presence of fuel oil or some other petroleum product in quantities not exceeding 5% by weight of the dry solids. The product may be extruded by subjecting the mixture to a compressive force of up to 6000 psi to produce a solid extrusion or formed product. Conventional extrusion machinery can be adapted to permit rapid drainage of excess water which is forced from the mixture during the extruding process. The moisture content of the extruded product will be less than 10% at the time of extrusion and after extrusion, additional moisture is rapidly aspirated, thus reducing the final moisture content to 5% or less by weight within 24 hours.

In one form of the present invention, there is provided a process for removing clay and pyrite from coal comprising forming a slurry of coal particles from a coal-feed stream contaminated with clay and pyrite, the coal particles having a desired mesh size; adjusting the pH of the slurry to maintain a colloidal dispersion wherein clay and pyrite particles are a colloid; forming a colloidal dispersion of clay and pyrite particles by agitating the slurry of coal particles to release clay and pyrite from the surface of the coal particles; recovering a slurry of coal particles having a size greater than 2 microns; adjusting the pH of the recovered slurry of coal particles to maintain a colloidal dispersion wherein clay and pyrite particles are a colloid; again forming a colloidal dispersion of clay and pyrite particles by releasing additional clay and pyrite from the surface of the coal particles; and recovering coal particles greater than 2 microns.

When the recovered slurry of coal particles is treated with ozone to again release further amounts of clay and pyrite particles which are dispersed as a colloid, the treatment is carried out in a chamber under quiescent conditions. The initial slurry of coal particles is comprised of at least 6% to 7% and up to about 40% by weight coal particles having a mesh size of 100 or less. After the slurry is agitated to release contaminants from the surface of the coal particles, the treated slurry which may be acidic, is separated in a separator, i.e, a centrifuge and frothing cells under controlled, e.g., near normal, pH conditions and thereafter the recovered product is, to a large extent, made up of solids comprising coal particles which can be repulped to form a slurry. A normalizing agent is added to the slurry to adjust the pH to again about normality for maintaining any subsequently freed impurities as a colloid in suspension in the aqueous medium of the slurry. The colloid is again separated from the coal particles.

Figure 2:
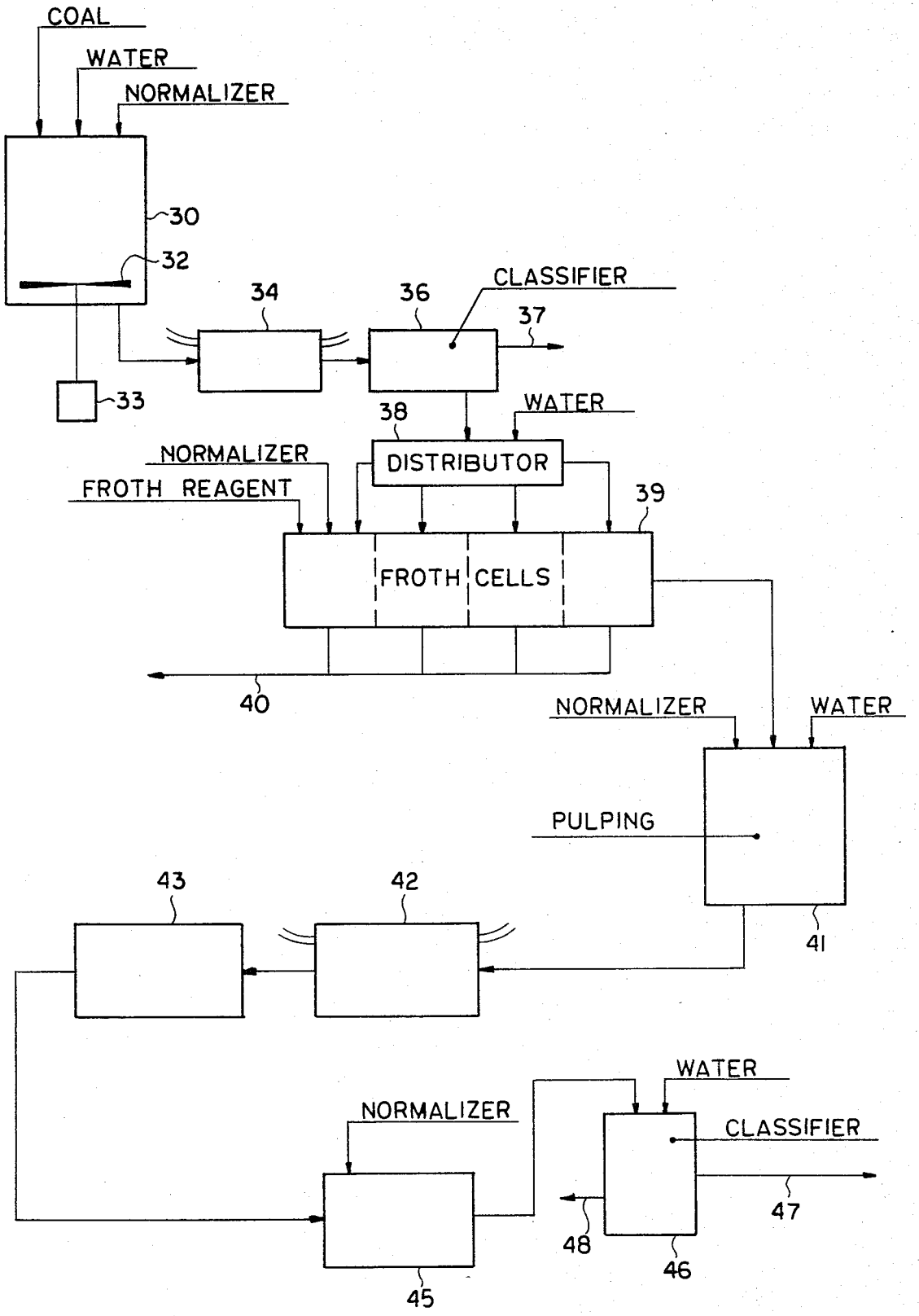

These features and advantages of the present invention as well as others will be more fully understood when the following description is read in light of the accompanying drawings, in which:

FIG. 1 is a diagrammatic flow sheet of one practical installation for treating a coal slurry according to the present invention; and FIG. 2 is a diagrammatic flow sheet of a preferred form of the installation for treating a coal slurry according to the present invention.

Feedstock for the process of the present invention may be freshly-mined coal or coal salvaged from silt ponds or other source. Delivery of the feedstock for processing is carried out by conventional state-of-the-art means. If desired, batching of the feedstock may be carried out in a suitable vessel. The particle size of the feedstock is typically 30 mesh or less but generally not greater than 4 mesh and is fed, as indicated in FIG. 1, into a vessel 10 together with suitable quantities of water to form a slurry having 10% to 30% by weight solids. If downstream separation by froth-flotation is intended, then it is preferred to use 30 mesh size or less coal particles. In the event a downstream separation by froth-flotation is not intended, then the feedstock can comprise particles as large as 4 mesh. A normalizer, such as calcium hydroxide, is added to the slurry which quickly becomes acidic in the vessel 10. The normalizer is added in sufficient quantities to adjust the pH to a range of 6 to 9. Depending upon the composition of the coal, the slurry will become highly acidic, e.g., a pH of as low as 2.2, while residing in vessel 10. By adjusting the pH of the slurry to approximately normal, i.e., within the range of 6 to 9, the present invention provides that particles of impurities are maintained as a colloid in suspension in the aqueous medium of the slurry. This prevents reattachment of the contaminant to the coal particles. The slurry is highly agitated by an impeller 12 in the bottom of the vessel. The impeller is driven by a motor in a suitable drive 13. After the slurry has been agitated for a suitable period of time, it is preferred to feed the slurry to an ultrasonic mixer 14 wherein the slurry is rigorously agitated by the use of sonic energy at an operating frequency within the range of 16–20 KHz. A reverberatory ultrasonic mixer such as presently available from Lewis Corporation of Oxford, Conn. can be used. Ash particles that are mechanically adhered to the surface of the coal particles are washed free of the coal particles. In addition, any weak chemical bond between the ash particles and the coal particles is further weakened by the violent agitation of the sonic generator. It is preferred to carry out the sonic treatment for a period of time which is sufficient to subdivide any coal particles at a seamline formed by a weak layer of ash. A newly-exposed, ash-covered surface of the coal particle is acted upon by sonic energy to free ash which is mechanically bonded as well as weaken the chemical bond between the ash and coal. The sonic treatment, however, must be limited to a period of time that will avoid destructive commutation of the coal particles. The duration of sonic treatment will normally vary with the type of coal undergoing treatment. If the structural integrity of the coal particles is insufficient to withstand sonic agitation, or if such agitation is not desired for some other reason, the coal slurry is fed from vessel 10 by way of line 15 to a distributor 16. Preferably, the agitated slurry is fed from mixer 14 to the distributor 16.

The distributor 16 disperses the coal slurry to a number of frothing cells in a vessel 17. A normalizer is added to readjust the pH of the slurry to normality, e.g., to a pH of 6–9. Oil or other froth reagent is added to carry out separation of the coal particles by froth-flotation. Froth-flotation may take place in one or more stages. The addition of reactants is controlled to produce the most effective separation of coal from the tailings. Usually, however, a single-stage flotation will suffice to separate coal from the tailings and maximize recovery of carbon from the feed to the frothing cells. It is not necessary, however, to meet the desired requirement of ash and sulfur contents of the coal particles at this stage of the process. The tailings are comprised essentially of ash, e.g., clay and usually small amounts of free sulfur and pyrite that are shakened loose from the coal particles. The tailings are discharged from the frothing cells by line 18 to a suitable facility for further treatment.

The coal particles with froth collected from the cells are fed to a vessel for repulping but it is preferred to direct the solids of the frothed product to a classifier 19 wherein coal particles having a size less than 2 to 5 microns are separated from particles of a greater size. The small particle product from the classifier will consist mainly of ash, sulfur and small quantities of coal of ultrafine size which burden the subsequent handling and treatment of economically-sized coal particles. It is to be understood that the coal slurry in vessel 10 or mixer 14 can be fed directly to the classifier 19 to process certain types of coal particles forming the feedstock. From the classifier 19, the coal particles having a size larger than 2 to 5 microns are fed to a vessel 20 wherein sufficient quantities of water and a normalizer are added to adjust the pH level to slightly alkaline and repulp the slurry to 10% to 30% by weight solids. The normalizer is preferably calcium hydroxide which will react with the contaminants in the slurry to form iron oxide and calcium sulfate. However, the amount of reacted contaminants is so small so that a separate treatment is unnecessary. It is preferred to repulp the coal particles into a slurry of 20% by weight solids. The normalizer of the repulped slurry maintains colloids of oxides, sulfides, ash and pyrite as suspended solids in the slurry. This is an important aspect of the present invention which substantially enhances the recovery of carbon by a subsequent separation in a classifier. Thus, it is particularly important to maintain the contaminants as colloids in suspension in the aqueous medium of the coal slurry. This is achieved principally by controlling the pH of the slurry during repulping and thereafter until the slurry is processed in a classifier.

From vessel 20, the repulped slurry is fed to a vessel 22. In its preferred form, the vessel 22 has a diameter-to-height ratio of 4:1 so that the repulped slurry which is introduced near the bottom of the vessel can rise slowly along the height thereof in a substantially quiescent condition. In the bottom of the vessel, there is a diaphragm 23 or other distributor means having openings from which a high energy compound, such as ozone, can pass into the slurry and upwardly along the vessel. The ozone in the aqueous phase of the slurry in the vessel oxidizes the carbonaceous surface of the coal and reacts by breaking the bond between ash, free sulfur and pyrite on the coal surface. Small, loosely-bonded flakes of pyrite can be effectively separated from the coal particles; however, so far as presently understood, this treatment of the aqueous slurry of coal particles does not remove sulfur constituents either as elemental sulfur or pyrite that are within the particle of coal beneath the surface thereof. The surface of the coal particles is altered by the ozone treatment to a hydrophobic nature. The amount of ozone that is used per ton of coal is generally less than 10 pounds per ton of coal and can be as low as 0.3 pound per ton of coal. The amount of ozone required corresponds to the amount of ozone that can be consumed primarily by reaction with pyrite only for separation from the coal surface. The treatment of sulfur with ozone should terminate before the sulfur of the pyrite is oxidized in significant amounts since this will require handling of calcium sulfate due to the reaction of the oxidized sulfur with the normalizer comprising calcium hydroxide. In this way, pyrite can be released from the coal and separated without altering the chemistry thereof and, therefore, environmentally acceptable. It is necessary to restrict treatment of the coal slurry with ozone within economical limits affected by the cost of the ozone, the loss of carbon of the coal particle, the material and construction of the vessel 22 and the ability to obtain a dispersion in the slurry.

The reaction time for the ozone with the slurry will vary with the conditions and may be as short as 1 minute, although longer periods may be necessary, depending upon the particular composition of the coal. It is desirable to carry out the reaction at a temperature which is elevated above ambient. It is believed a pressure above atmospheric pressure will enhance the reaction with ozone. Steam may be injected into the vessel; however, to maintain the quiescent condition of the slurry while undergoing treatment in the vessel, it is preferred to arrange heat transfer pipes in the vessel and/or arrange a steam jacket about the outer surface of the vessel for heating the slurry therein. The pressure in the vessel is typically less than 2 atmosphere, although no criticality is known to exist. Other process parameters in the vessel 22 are based on the discovery that the coal particles that are larger than 30 mesh in size undergo a minimal effective treatment with ozone. The modification to the coal surface reduces surface tension characteristics of the coal to water which facilitates separation of any residual ash and sulfur materials may be adhered to the coal surface.

It is also to be understood that the repulped slurry in vessel 20 may be treated in an ultrasonic mixer 21 in the same manner as the slurry is treated in mixer 14. In the event it is not desirable to treat a given feedstock with ozone, then the agitated repulped slurry from the mixer 21 is fed to a vessel for normalizing as will be described hereinafter. The slurry from mixer 21, when used, can be fed to a vessel 22 for treatment with ozone.

After treatment in vessel 22, the treated repulped slurry is fed to a vessel 24 wherein the pH of the slurry is adjusted to between 6–9 by the addition of a normalizer, such as calcium hydroxide. The slurry is then fed to a centrifugal classifier such as made by Bird Machine, South Walpole, Mass. or Sharpless. The classifier is preferably a solid or screen bowl centrifuge 25, per se, known in the art for separating clay particles from tailings. This invention used the centrifuge in a different manner to separate coal from clay. Screens can be used. A 200-mesh size screen may be suitable for certain feeds depending upon particle size distribution therein but may be economically undesirable. The centrate from the classifier will be of ultrafine size occurring as colloids suspended in the aqueous medium of the slurry. This facilitates recovery of the coal particles by operational techniques of the centrifuge. Water is introduced into the classifier to enhance the separation process. The moisture in the final coal product recovered from the classifier will not be in excess of 50% moisture and may be as low as 15% moisture. The coal product, if desired, is discharged from the classifier into a static mixer 26 where it can be admixed with fuel oil or other suitable petroleum liquid or other agent in quantities above about 2% by weight, but not more than 5% by weight. When oil is used in the mixer, each particle of coal is coated with oil, thus freeing the particle from residual moisture and permitting migration of the moisture to the perimeter of the mixer. The oil has a natural affinity of the carbon of the coal particle. The coal particles treated in the mixer 26 are fed, if desired, into an extruder 27 where a binder such as limestone is admixed with the coal product and an extrusion is formed of suitable size for handling and shipment. If desired, the extrusion may be baked in a suitable environment to enhance the physical properties. Immediately after leaving the extruder, the extruded product will contain not over 8% to 10% surface moisture and within 24 hours, the moisture content will be reduced to 6% surface moisture. A press can be used in place of extruder 27 such as a Boyd Press manufactured by Chrisholm, Boyd and White of Alsip, Ill. Unless extreme pressure is generated, a binder is required. A forming pressure of approximately 3500 psi will be sufficient when using about 3% hydrated lime or cement as the binder.

The feed to extruder 27 or the press has to contain the proper moisture content. When operating at ambient temperature, the product from classifier 25, when treating with ultrafine feedstock containing 40% or more of minus 25-micron particles, will not be low enough in moisture to be directly fed to the press. If the slurry is heated, the moisture content will be lowered to 30% or less and will be satisfactory. However, the preferred moisture content in the feed to the press is 24% to 28%. If the system is operated at ambient temperature, it will be necessary to use a belt press, such as one manufactured by Eimco of Salt Lake City, between classifier 26 and the extruder. Whether the slurry is heated or not, is a matter of economics.

In the same manner as described previously, feedstock for the embodiment of the process shown in FIG. 2 of the present invention may be freshly-mined coal or coal salvaged from silt ponds or other source. Dissolved salts in the water supply should be treated to avoid the existence of a strong electrolyte in the aqueous medium of the coal slurry. The existence of such an electrolyte is detrimental and under extreme conditions will prevent the formation of a colloidal dispersion of clay particles. Sodium chloride, for example, in a water supply is treated with lime to form a precipitate of calcium carbonate, thus freeing the water of the electrolyte before a coal slurry is formed. As shown in FIG. 2, feedstock typically 30 mesh or less is fed into a vessel 30 together with suitable quantities of water to form a slurry having 10% but preferably at least about 40% by weight solids. A normalizer, such as calcium hydroxide, is added to the slurry in the vessel 30 in sufficient quantities to adjust the pH to a range of 6 to 9 which provides that particles of impurities are maintained as a colloid in suspension in the aqueous medium of the slurry. This prevents reattachment of the contaminant to the coal particles. The slurry is highly agitated by an impeller 32 in the bottom of the vessel. The impeller is driven by a motor in a suitable drive 33. After the slurry has been agitated for a suitable period of time, the slurry is fed to an ultrasonic mixer 34 which is the same as mixer 14 in FIG. 1 and wherein the slurry is rigorously agitated by the use of sonic energy at an operating frequency within the range of 16–20 KHz. Ash particles, principally clay and pyrite particles, that are mechanically adhered to the surface of the coal particles are washed free of the coal particles. In addition, any weak chemical bond between these particles and the coal particles is further weakened by the violent agitation of the sonic generator. The sonic treatment can be carried out for a period of time which is sufficient to subdivide any coal particles at a seamline formed by a weak layer of clay. A newly-exposed, clay-covered surface of the coal particle is acted upon by sonic energy to free the clay as well as pyrite particles mechanically bonded and/or weakly chemically bonded to the coal. The sonic treatment, however, must be limited to a period of time that will avoid destructive commutation of the coal particles. The duration of sonic treatment will normally vary with the type of coal undergoing treatment.

The combination of ultrasonic energy and the corrected pH of liquid medium of the slurry maintains the released contaminated particles dispersed in the liquid medium and forms a colloidal dispersion. The coal slurry is fed from the ultrasonic mixed 34 by way of line 35 to a classifier 36. The classifier is preferably a solid bowl centrifuge having a preselected beach angle which, when operated to develop between 2000 to 3000 times the force of gravity on the slurry, separates therefrom a fraction comprised of substantially all particles of the minus 2 micron size. This fraction is comprised of about 80% to 90% colloid, i.e., contaminants and the remainder being undersized carbon. The minus 2 micron fraction is discharged by line 37 from the process. The centrate from the centrifuge is then fed to a distributor 38 and mixed with a make-up quantity of water to form a slurry which is distributed to a number of frothing cells in a vessel 39. A normalizer is added to readjust the pH of the slurry to normality, e.g., to a pH of 6–9. A froth reagent is added to carry out separation of the coal particles by froth-flotation. Froth-flotation may take place in one or more stages. The addition of reactants is controlled to produce the most effective separation of coal from the tailings. Usually, however, a single-stage flotation will suffice to separate coal from the tailings and maximize recovery of carbon from the feed to the frothing cells. The treatment of the coal particles in the froth cells further the clean-up of the coal by separating plus 2 micron contaminants from the carbon. It is not necessary, however, to meet the desired requirement of clay and pyrite contents of the coal particles at this stage of the process. The tailings are comprised essentially of ash, e.g., clay, and usually small amounts of free sulfur and pyrite that are shakened loose from the coal particles. The tailings are discharged from the frothing cells by line 40 to a suitable facility for further treatment.

The coal slurry is a heterogeneous mixture of coal and small particles of shale/clay in water. The use of ultrasonic mixers enhances separation of coal particles from contaminants in the froth-flotation cells where a separation is obtained between discrete particles of ash (clay/shale) and coal; and further in the operation of the centrifugal separation process where the ash (clay/-shale) in the submicron or low micron size fraction is concentrated and separated from the coal. The micron sized pieces of clay are separated from any coal and there is also a breaking up of any agglomerated particles of clay.

In this way, the recovery of a lower ash coal product is achieved by the use of ultrasonics by which electrical power is transformed into physical wave energy of a specified frequency that will interact with the particles causing them to physically separate. In achieving this and then maintaining the separation until the next operation is based on an underlying theory that forces attracting particles together and then keeping them together are van der Waals forces and electrical attraction repulsion forces. The van der Waals forces are essentially equivalent to gravitational forces and can be easily overcome by electrical repulsion. The electrical attraction repulsion forces affect colloidal sized particles that become negatively-charged particles with cations on their surface that go into solution. This negative charge is evenly distributed over the particle and results in a shell around the particle with a specific charge. This charge can be neutralized with positively-charged cations in solution around the particle. In the colloidal size range such as the clays (minus 2 microns), these charged particles repulse each other and the electrical repulsion maintains the stability of the suspension. This charge, known as the zeta potential, can be controlled by the pH and the type of cation on the particle. Since this is a surface phenomena, the zeta potential is only sufficient to keep particles that have a high surface area to mass ratio in suspension. Therefore, this is a colloidal sized particle property which is more pronounced in the small clay particles than in the larger coal particles. The maintenance of a pH stable solution is called peptization. Ultrasonices can temporarily overcome coagulation but it requires the control of the electrolyte concentration and pH to maintain stability.

The above forces control coagulation or peptization. Van der Waals forces are relatively weak due to the small particle sizes involved and cannot be controlled. The charge on the colloidal sized particles (zeta potential) can be controlled and is the major force involved. The coal particles tend to be larger than the clay particles and do not generally exhibit colloidal properties. The coal particles may maintain a slight negative charge (zeta potential) but the particles are too large for this charge to control the stability. However, because of the zeta potential, the clay particles may attach to the coal particles. The control or the stability of the clays will definitely be influenced by these electrical surface properties.

Therefore, a peptized, ultrasonically-treated coal slurry of discrete particles of coal (plus inherent ash) and clay (ash) can be effectively beneficiated by froth-flotation. The separation of ash and coal in froth-flotation is based on two principles. First, the frothing results in the coal floating to the surface where it is recovered; and secondly, ash is left behind in the suspension. Relatively large particles of ash in this suspension will sink. With colloidal sized ash or clay, the particles will be evenly distributed throughout the suspension. This means that any water removed with the froth will have the same concentration of ash as the water going out of the froth cell with the tailings. The objective of the process of the present invention is to recover only clean coal. To avoid ash in any water exiting with the froth from the froth cells, most of the very fine ash or clay is removed by operation of the classifier 36 so that these particles will not be dispersed throughout the froth cell to be partially recovered with the froth product. Therefore, the preferred process is to ultrasonically treat peptized suspension, followed by a centrifugal removal of the fine clays, and then froth-flotation.

The coal particles with froth collected from the cells are fed to a vessel 41 for repulping by the addition of sufficient quantities of water. A normalizer is added to again adjust the pH level to between 6–9. The repulped slurry will comprise at least 10% but usually 40% or more by weight solids. The normalizer can be calcium hydroxide. Because the repulped slurry is again treated to adjust the pH to between 6–9, it is again possible to maintain colloids of oxides, sulfides, clay and pyrite as dispersed solids in the slurry. This is an important aspect of the present invention which substantially enhances the recovery of carbon by a subsequent separation in a classifier. Thus, it is particularly important to maintain the contaminants as colloids in suspension, i.e., form a colloidal dispersion, in the aqueous medium of the coal slurry. This is achieved principally by assuring that the pH of the slurry remains in the 6–9 range until the slurry is processed in a classifier.

From vessel 41, the repulped slurry is fed to a second ultrasonic mixer 42 wherein the slurry is treated with ultrasonic energy in the same manner as the slurry is treated in ultrasonic mixer 34. Additional contaminants, clay and pyrite generally minus 2 microns in size, are again retained as a colloid in a colloidal dispersion. Still further quantities of minus 2 micron particles of contaminants may, if desired, be released from the coal particles in the slurry by treating the slurry with high energy compounds. For this purpose, in its preferred form, the slurry is fed to a vessel 43 which is the same as vessel 22 in FIG. 1. The repulped slurry which is introduced near the bottom of the vessel rises slowly along the height thereof in a substantially quiescent condition. In the bottom of the vessel, there is a diaphragm or other distributor means having openings from which a high energy compound, such as ozone, can pass into the slurry and upwardly along the vessel. The ozone in the aqueous phase of the slurry in the vessel oxidized the carbonaceous surface of the coal and reacts by breaking the bond between clay and pyrite on the coal surface. Small, loosely-bonded flakes of pyrite can be effectively released and separated from the coal particles. The surface of the coal particles is altered by the ozone treatment to a hydrophobic nature. The amount of ozone that is used per ton of coal is generally less than 10 pounds per ton of coal and can be as low as 0.3 pound per ton of coal. The amount of ozone required corresponds to the amount of ozone that can be consumed primarily by reaction with pyrite as in the embodiment of FIG. 1. Ozone is used to effectively release pyrite flakes at the surface of the coal particle.

The reaction time for the ozone with the slurry will vary with the conditions and may be as short as 1 minute, although loner periods may be necessary, depending upon the particular composition of the coal. It is desirable to carry out the reaction at a temperature which is elevated above ambient and at a pressure above atmospheric pressure to enhance the reaction with ozone. As in the embodiment of FIG. 1, steam may be injected into the vessel; however, to maintain the quiescent condition of the slurry while undergoing treatment in the vessel, it is preferred to arrange heat transfer pipes in the vessel and/or arrange a steam jacket about the outer surface of the vessel for heating the slurry therein. The modification to the coal surface reduces surface tension characteristics of the coal to water which facilitates separation of any residual clay and pyrite materials may be adhered to the coal surface.

After treatment in vessel 43, the slurry is fed to a vessel 45 wherein the pH of the slurry is again adjusted to between 6–9 by the addition of a normalizer, such as calcium hydroxide. The slurry is then fed to a centrifugal classifier 46 which is the same as classifier 25 in FIG. 1 and preferably a centrifuge used in a non-conventional manner to separate coal from clay. A 200-mesh size screen may be used but may be economically undesirable. The centrate from the classifier will be of ultrafine size occurring as colloids suspended in the aqueous medium of the slurry. This facilitates recovery of the coal particles by operational techniques of the centrifuge. A detergent or surfactant and/or water can be introduced into the classifier to enchance the separation process. The moisture in the final coal product recovered from the classifier will not be in excess of 50% moisture and may be as low as 15% moisture. The coal product is discharged from the classifier by line 47 to a selected site for use of the coal particles such as feedstock for producing a coal-water mixture. The undersized fraction, e.g., minus 2 microns comprised mainly of clay and pyrite, is discharged from classifier 46 by line 48. The coal particles can be mixed with a binder in a mixer and fed into an extruder or a press to form a product of suitable size for handling and shipment.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A process for removing clay and pyrite from coal comprising:

forming a slurry of coal particles from a coal-feed stream contaminated with clay and pyrite, the coal particles having a desired mesh size, adjusting the pH of the slurry to maintain a colloidal dispersion wherein clay and pyrite particles are a colloid, forming a colloidal dispersion of clay and pyrite particles by agitating the slurry of coal particles to release clay and pyrite from the surface of the coal particles, recovering a slurry of coal particles having a size greater than 2 microns, adjusting the pH of the recovered slurry of coal particles to maintain a colloidal dispersion wherein clay and pyrite particles are a colloid, again forming a colloidal dispersion of clay and pyrite particles by releasing additional clay and pyrite from the surface of the coal particles, and recovering coal particles greater than 2 microns.

2. The method according to claim 1 wherein coal particles in said feed stream have a mesh size of 30 or less and comprise 6% to 7% by weight in the slurry formed therefrom.

3. The method according to claim 1 wherein said forming a colloidal dispersion includes subjecting the slurry to ultrasonic energy.

4. The method according to claim 3 wherein the slurry of coal particles is treated with ultrasonic energy for a period of time sufficient to free adhered ash from the surface of the coal particles.

5. The method according to claim 3 wherein the slurry of coal particles is treated with ultrasonic energy for a period of time sufficient to weaken the bond between ash particles and coal.

6. The method according to claim 3 wherein the slurry of coal particles is treated with ultrasonic energy for a period of time sufficient to fracture coal particles along an ash inclusion layer.

7. The method according to claim 1 wherein said step of again forming a colloid includes introducing into the slurry of coal particles about 0.3 to 10 pounds of ozone per ton of coal.

8. The method according to claim 7 wherein said slurry of coal particles is maintained in a substantially quiescent environment while introducing said ozone.

9. The method according to claim 7 wherein said slurry of coal particles is maintained at a temperature and pressure substantially above ambient while introducing said ozone.

10. The method according to claim 1 wherein said step of recovering a slurry of coal particles includes separating coal particles from tailings in froth-flotation cells.

11. The method according to claim 7 wherein said step of again forming a colloidal dispersion includes passing the recovered slurry vertically in a chamber having a ratio of diameter-to-height of at least 4:1 while introducing said ozone.

12. The method according to claim 1 wherein said step of recovering coal particles includes separating coal particles from the slurry in a centrifuge.

13. The method according to claim 12 wherein said step of recovering coal particles includes dewatering the coal particles separated in a centrifuge.

14. The method according to claim 13 wherein said dewatering includes mixing oil with the coal particles.

15. The method according to claim 14 including the further step of forming an extrusion from the dewatered coal particles.

16. The method according to claim 15 including the further step of admixing a binder with the dewatered coal particles for said step of forming an extrusion.

17. A process for removing clay and pyrite from coal comprising:

forming a slurry of coal particles from a coal-feed stream contaminated with clay and pyrite, the coal particles having a desired mesh size, adjusting the pH of the slurry to about normality to suspend clay and pyrite particles as a colloid, forming a colloidal suspension of clay and pyrite particles by agitating the slurry of coal particles to release clay and pyrite from the surface of the coal particles, recovering a slurry of coal particles having a size greater than 2 microns, adjusting the pH of the recovered slurry of coal particles to again form a colloidal suspension of clay and pyrite particles, again forming a colloidal suspension of clay and pyrite particles by releasing additional clay and pyrite from the surface of the coal particles, and recovering coal particles greater than 2 microns.

18. The method according to claim 17 wherein coal particles in said feed stream have a mesh size of 30 or less and comprise 6% to 7% by weight in the slurry formed therefrom.

19. The method according to claim 17 wherein said forming a colloidal suspension includes subjecting the slurry to ultrasonic energy.

20. The method according to claim 19 wherein the slurry of coal particles is treated with ultrasonic energy for a period of time sufficient to free adhered ash from the surface of the coal particles.

21. The method according to claim 19 wherein the slurry of coal particles is treated with ultrasonic energy for a period of time sufficient to weaken the bond between ash particles and coal.

22. The method according to claim 19 wherein the slurry of coal particles is treated with ultrasonic energy for a period of time sufficient to fracture coal particles along an ash inclusion layer.

23. The method according to claim 17 wherein said step of again forming a colloid includes introducing into the slurry of coal particles about 0.3 to 10 pounds of ozone per ton of coal.

24. The method according to claim 23 wherein said slurry of coal particles is maintained in a substantially quiescent environment while introducing said ozone.

25. The method according to claim 23 wherein said slurry is maintained at a temperature and pressure substantially above ambient while introducing said ozone.

26. The method according to claim 17 wherein said step of recovering a slurry of coal particles includes separating coal particles from tailings in froth-flotation cells.

27. The method according to claim 23 wherein said step of again forming a colloidal suspension includes passing the recovered slurry vertically in a chamber having a ratio of diameter-to-height of at least 4:1 while introducing said ozone.

28. The method according to claim 17 wherein said step of recovering coal particles includes separating coal particles from the slurry in a centrifuge.

29. The method according to claim 28 wherein said step of recovering coal particles includes dewatering the coal particles separated in a centrifuge.

30. The method according to claim 29 wherein said dewatering includes mixing oil with the coal particles

31. The method according to claim 30 including the further step of forming an extrusion from the dewatered coal particles.

32. The method according to claim 31 including the further step of admixing a binder with the dewatered coal particles for said step of forming an extrusion.

* * * * *